United States Patent [19]

Herrington et al.

[11] Patent Number: 5,010,627

[45] Date of Patent: Apr. 30, 1991

[54] FOLDABLE PLASTIC SLIDER AND METHOD OF ASSEMBLY WITH A PLASTIC RECLOSABLE FASTENER

[75] Inventors: Fox J. Herrington, Holcomb; Alex Goncarovs, Canandaigua, both of N.Y.

[73] Assignee: Mobil Oil Corporation, Fairfax, Va.

[21] Appl. No.: 490,108

[22] Filed: Mar. 7, 1990

[51] Int. Cl.[5] ..... A44B 19/00

[52] U.S. Cl. ..... 24/400; 24/399; 24/587

[58] Field of Search ..... 24/400, 399, 587, 576, 24/297; 383/63, 65; 156/66

[56] References Cited

U.S. PATENT DOCUMENTS

| | | | |
|---|---|---|---|
| 3,103,049 | 9/1963 | Hawley | 24/400 |
| 3,220,076 | 11/1965 | Ausnit et al. | 24/201 |
| 3,347,298 | 10/1967 | Ausnit et al. | 150/3 |
| 3,426,396 | 2/1969 | Laguerre | 24/201 |
| 3,462,332 | 8/1969 | Goto | 156/244 |
| 3,579,747 | 5/1971 | Hawley | 24/400 |
| 3,660,875 | 5/1972 | Gutman | 24/201 |
| 3,713,923 | 1/1973 | Laguerre | 156/66 |
| 3,790,992 | 2/1974 | Herz | 24/201 |
| 3,806,998 | 4/1974 | Laguerre | 24/201 |
| 4,262,395 | 4/1981 | Kosky | 24/400 |
| 4,517,710 | 5/1985 | Beckmann | 24/297 |
| 4,736,451 | 4/1988 | Ausnit . | |

FOREIGN PATENT DOCUMENTS

| | | | |
|---|---|---|---|
| 1109532 | 1/1956 | France | 24/400 |
| 0914203 | 12/1962 | United Kingdom | 24/400 |
| 0914204 | 12/1962 | United Kingdom | 24/400 |
| 1139838 | 1/1969 | United Kingdom | 24/297 |

*Primary Examiner*—Victor N. Sakran

*Attorney, Agent, or Firm*—Alexander J. McKillop; Charles J. Speciale

[57] ABSTRACT

A foldable plastic slider having one or more hinged wings that fold and snap permanently in place to attach it to the plastic reclosable fastener elements when manufacturing a thermoplastic bag.

11 Claims, 4 Drawing Sheets

FOLDABLE PLASTIC SLIDER AND METHOD OF ASSEMBLY WITH A PLASTIC RECLOSABLE FASTENER

BACKGROUND OF THE INVENTION

The present invention relates to improvements in plastic sliders for opening and closing plastic reclosable fasteners on plastic bags and the like and the method of assembling a foldable plastic slider with a profiled plastic reclosable fastener on the plastic bags.

Zippers with sliders are made commercially in several forms. The most common ones used on clothing have teeth which interlock. The teeth may be made of metal or plastic. Other types of plastic zippers have profiles and include a pair of male and female fastener elements in the form of reclosable interlocking rib and groove elements with a slider for opening and closing the rib and groove elements. In the manufacture of thermoplastic film bags, a pair of these male and female fastener elements extend along the mouth of the bag and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332.

The sliders for opening or closing the reclosable fasteners are essentially U-shaped and adapted to be assembled with the fastener or zipper by an endwise assembly or by a relative transverse maneuver. Where the assembly is performed by a relative transverse maneuver the slider is normally molded from a semi-hard plastic where there is enough yieldability in the side walls of the slider to provide sufficient flexibility to enable spreading apart of the terminal portions of the side walls of the slider so as to clear the interlocking rib and groove elements to permit assembly of the slider with the zipper by relative transverse movement. Where the slider is formed from a metal die casting or a hard plastic, it is then necessary to rely upon the plastic deformation of the plastic zipper elements to permit the transverse assembly movement of the slider. Such assembly can cause damage to the interlocking rib and groove elements during assembly and leaves something to be desired. Examples of assembly of the sliders with plastic reclosable fasteners are disclosed in U.S. Pat. Nos. 3,426,396, 3,660,875, 3,713,923, 3,790,992 and 3,806,998.

RELATED APPLICATIONS

A method of assembling a metal slider with a plastic reclosable fastener is disclosed in the related application entitled "Method of Assembling a Metal Slider with a Plastic Reclosable Fastener" Ser. No. 490,114 filed concurrently herewith and incorporated herein by reference thereto. A method of assembling a plastic slider with a plastic reclosable fastener is disclosed in the related application entitled "Method of Assembling a Snapped-Together Multi-part Plastic Slider with a Plastic Reclosable Fastener" Ser. No. 490,107 filed concurrently herewith and incorporated herein by reference thereto. Another method of assembling a multi-part plastic slider with a plastic reclosable fastener is disclosed in the related application entitled "Method of Assembling a Multi-Part Plastic Slider with a Plastic Reclosable Fastener by Ultrasonic Welding" Ser. No. 490,109 filed concurrently herewith and incorporated herein by reference thereto. Another plastic zipper and slider is disclosed in related application entitled "Rolling Action Zipper Profile and Slider Therefor" Ser. No. 490,110 filed concurrently herewith and incorporated herein by reference thereto. Another foldable plastic slider is disclosed in related application entitled "Gull Wing Zipper Slider" Ser. No. 490,106 filed concurrently herewith and incorporated herein by reference thereto. All of the above-identified related applications are assigned to the same assignee as the present application.

SUMMARY OF THE INVENTION

It is an object of the present invention to provide a new and improved foldable plastic zipper slider and method of assembling the same with a profiled plastic reclosable fastener without deforming the fastener during assembly of the slider therewith.

The present invention relates to a foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking rib and groove profile elements on the respective sheets. The straddling slider for closing or opening the reclosable fastener elements comprises a wedge-shaped separator finger and interlocking complementary structure formed from plastic for moving along the fastener, the complementary structure comprising a transverse support member having the wedge-shaped separator finger depending therefrom, the support member having depending structure and a pair of side wall hinged to the support member at locations adjacent the depending structure and foldable relative to the depending structure for connection thereto. The walls extend from an opening end of the slider to the closing end, the side walls being spaced wider apart at the opening end to permit separation of the rib and groove elements by the wedge-shaped separator finger extending between the side walls at the opening end, the side walls being spaced sufficiently close together at the closing end to press the rib and groove elements into interlocking relationship as the slider is moved in a fastener closing direction. At least one of the separator finger and the side walls have shoulder structure at the bottom thereof for cooperating with the bottom of the fastener to prevent the slider from being lifted off the top edges of the fastener while the slider straddles the fastener. In a preferred form of the invention, the hinged pair of side walls are integral with the support member and means is provided for interlocking the depending structure with the side walls to interlock the side walls with the support member. In one form of the invention, the depending structure comprises depending legs on opposite sides of the support member and the pair of side walls are hinged to the support member at locations intermediate the depending legs.

It is a further object of the invention to provide a method of assembly of a plastic slider in straddling relation with a profiled plastic reclosable fastener particularly suited for thermoplastic bags and the like formed by a pair of flexible sheets each having a top edge with separable fastener means extending along the length thereof comprising reclosable interlocking rib and groove profile elements on the respective sheets.

The straddling slider for closing or opening the reclosable fastener elements comprises a wedge-shaped separator finger and complementary structure formed from plastic for moving along the fastener, the complementary structure including hinged side walls extending from an opening end of the slider to a closing end, the side walls being spaced wider apart at the opening end to permit separation of the rib and groove elements, the wedge-shaped separator finger extending between the side walls at the opening end, the side walls being spaced sufficiently close together at the closing end to press the rib and groove elements into interlocking relationship as the slider is moved in a fastener closing direction. The method comprises the steps of placing the interlocking rib and groove profile elements in facing alignment so that they can be joined, supporting the wedge-shaped separator finger between the rib and groove profile elements, pressing the rib and groove profile elements together so that the profiles are interlocked at the location adjacent the closing end of the slider and against the sides of the wedge-shaped separator finger, folding the pair of side walls in a direction toward the separator finger so that the side walls straddle the rib and groove profile elements of the fastener, and securing the pair of side walls in folded position relative to the separator finger to prevent the slider from being lifted off the top edge of the fastener while the slider straddles the fastener.

Other objects, features and advantages of the invention will become apparent from the following detailed description of the invention taken in conjunction with the accompanying drawings.

PREFERRED EMBODIMENT OF THE INVENTION

Figure 1:
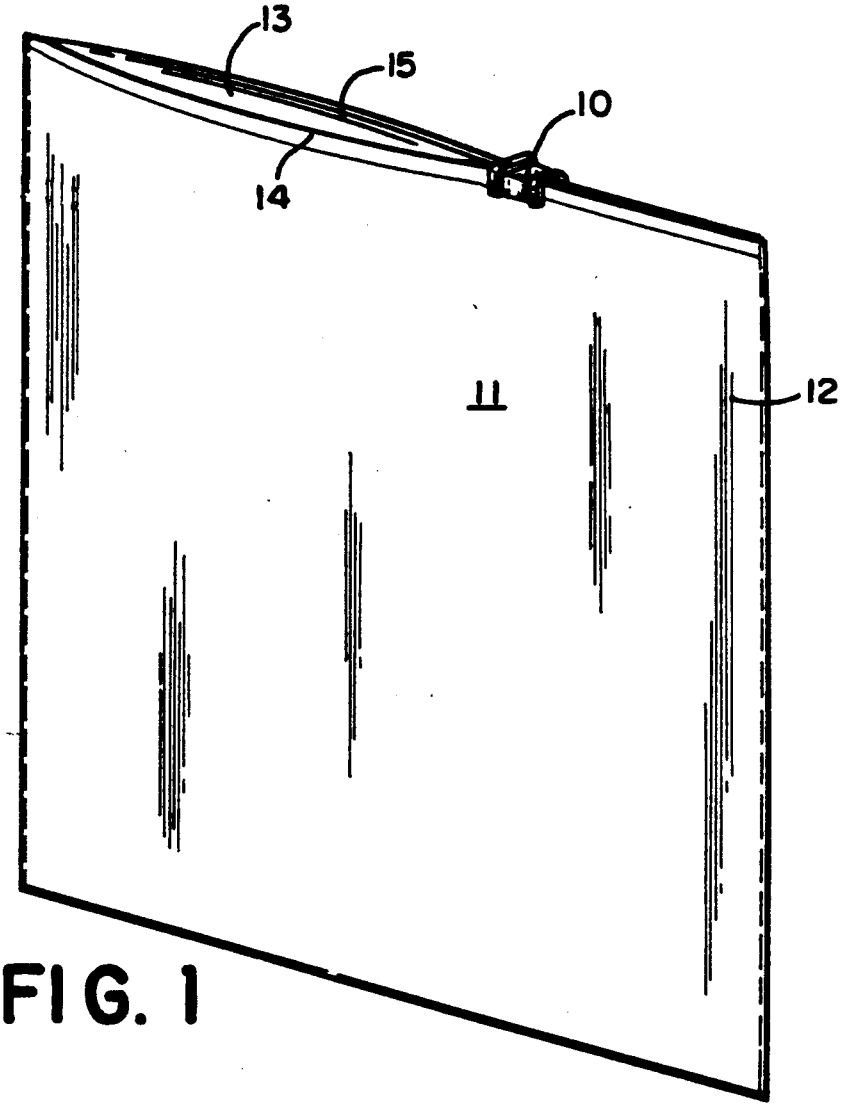
FIG. 1 is a perspective view of a thermoplastic bag or the like having a foldable plastic slider embodying the present invention assembled on the separable fastener means at the top edge of the bag in accordance with the method embodying the present invention.

Referring to FIG. 1, there is illustrated a foldable plastic slider 10 for a profile plastic reclosable fastener embodying the present invention. The slider 10 is particularly suited for thermoplastic bags and the like and has been illustrated in FIG. 1 in connection with the thermoplastic bag 11. The bag 11 may be made from any suitable thermoplastic film such for example as polyethylene or polypropylene or equivalent material. The bag 11 is formed by a pair of flexible plastic sheets 12 and 13 having a top edge with separable fastener means at the top edge extending along the length thereof having reclosable interlocking rib and groove profile elements 14 and 15 on the facing surfaces thereof. As pointed out above, in the manufacture of thermoplastic film bags, the pair of male and female fastener elements 14 and 15 extend along the mouth of the bag and these (interlocking rib and groove profiles) elements are adapted to be secured in any suitable manner to the flexible walls of the thermoplastic film bags. These elements may be integral marginal portions of such walls or they may be extruded separately and thereafter attached to the walls along the mouth of the bag as well known in the art. The elements 15 and 14 are attached to the respective walls of the bag on opposite sides of the bags as disclosed in FIGS. 1–8. The cross-sectional shapes of the interlocking rib and groove profiles 15 and 14 and the slider 10 are the subject of the invention claimed in the aforesaid related application entitled "Rolling Action Zipper Profile and Slider Therefore" Ser. No. 490,110 filed concurrently herewith and incorporated herein by reference thereto. The manner of attaching these elements to the respective walls of the bag is well known in the art and does not form part of the present invention.

Figure 2:
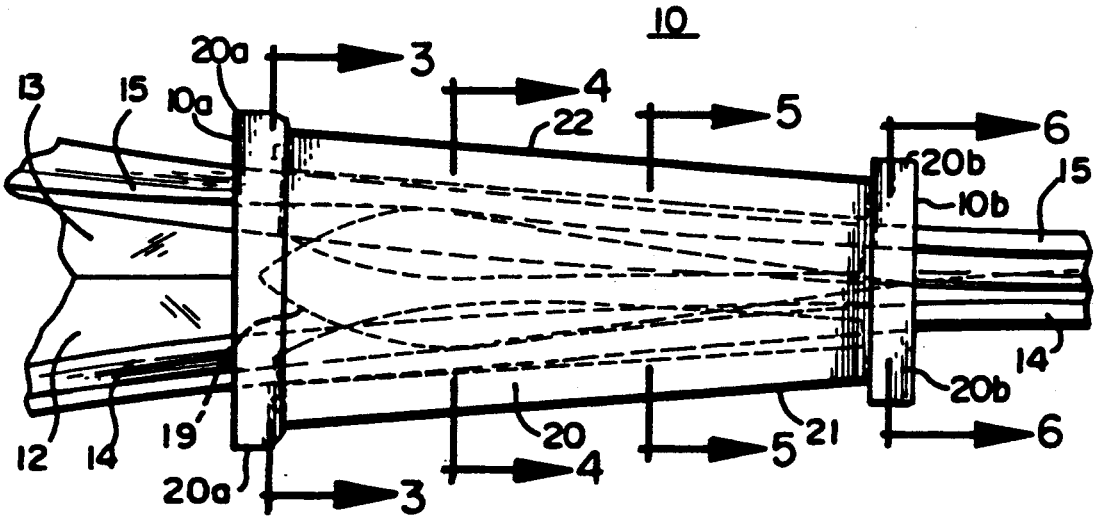
FIG. 2 is a fractional top plan view on enlarged scale of the slider shown in FIG. 1.
Figure 7:
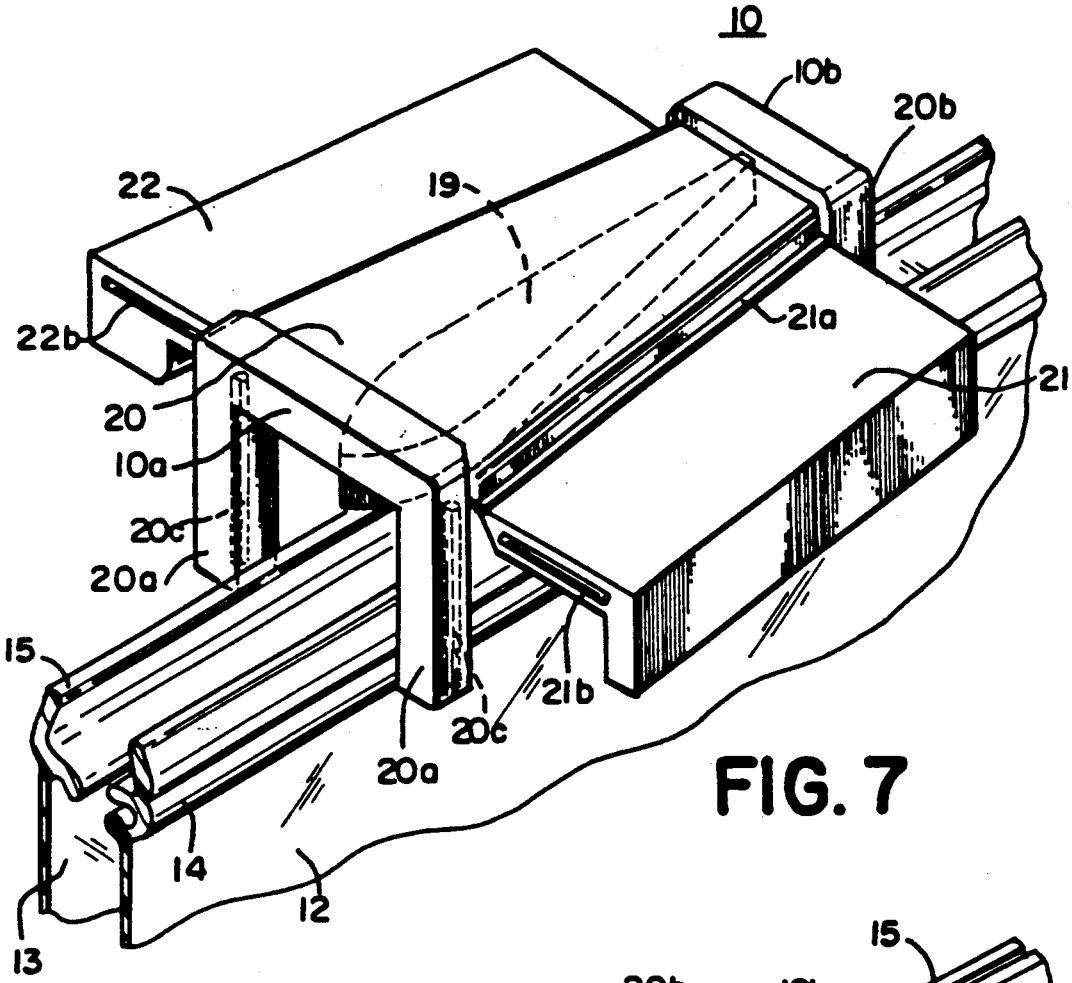
FIG. 7 is a perspective view showing the foldable slider in open position and illustrating the method of assembling the foldable plastic slider of FIGS. 1 and 2 with the profiled plastic reclosable fastener in accordance with the present invention.
Figure 8:
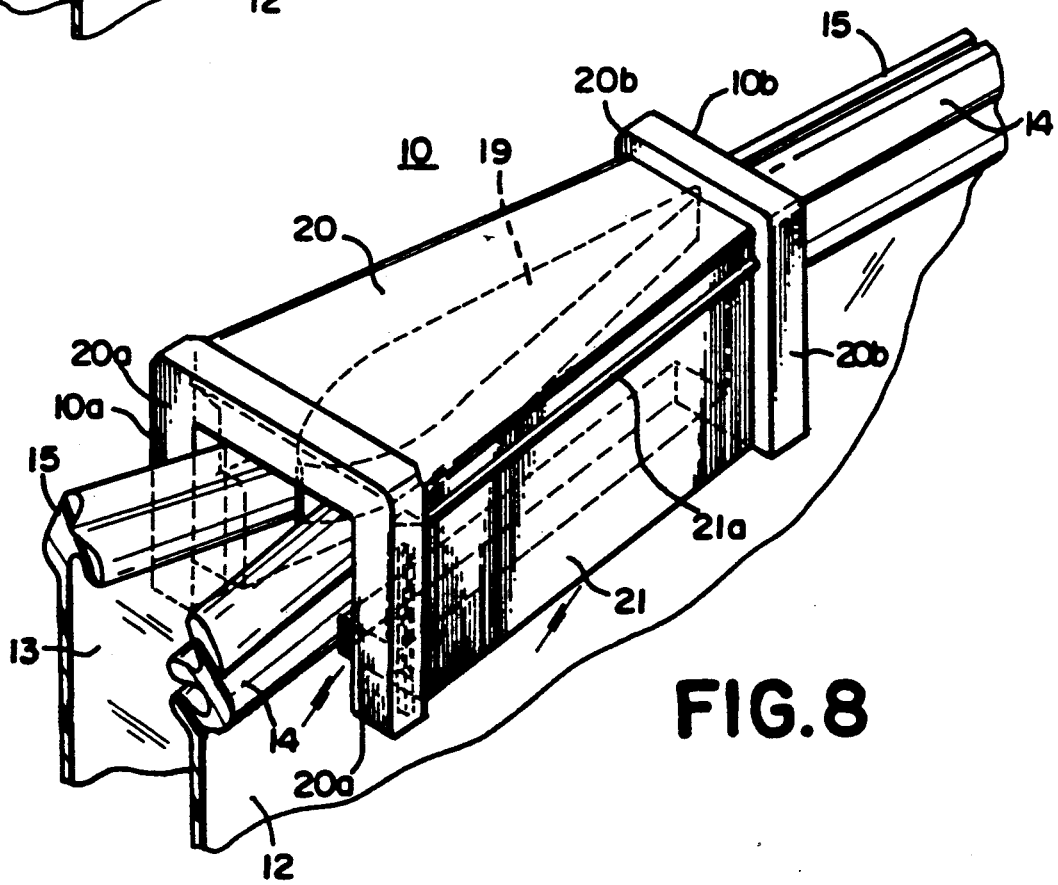
FIG. 8 is a perspective view of the foldable plastic slider of FIGS. 1, 2 and 7 assembled according to FIG. 7.

As may be seen in FIGS. 1, 2 and 8 the slider 10 straddles the reclosable fastener elements 14, 15 at the top of the bag 11 and is adapted for opening or closing the reclosable fastener elements. The novel slider 10 is formed from a single piece of molded plastic comprising a wedge-shaped separator finger 19 and interlocking complementary structure for moving along the fastener. The slider 10 may be molded from any suitable plastic such for example as nylon, polypropylene, polystyrene, Delrin or ABS. In the preferred embodiment the complementary structure comprises an inverted U-shaped member including a transverse support member or body 20 from which the wedge-shaped separator finger 19 depends. The body 20 is adapted to move along the top edges of the fastener elements 14 and 15 and includes a pair of hinged "wings" or side walls 21 and 22 that can be folded down into their final position, holding the slider 10 onto the fastener elements. The wings 21 and 22 are hinged to the main slider body 20 by means of hinge structure **21*a* and 22*a*. The hinge structure 21*a* and 22*a* is a relatively thin section of the plastic material as compared to the wall thicknesses of the wings 21 and 22 and the flexibility of the plastic material makes possible the use of the integral hinge structure 21*a* and 22*a* which is sometimes referred to as a "living" hinge. At the opposite ends of the slider 10 the main body 20 is provided with depending structure in the form of two pairs of legs 20*a*, 20*b* and as may be seen in FIGS. 2, 7 and 8 the wings or foldable side walls 21 and 22 are positioned between the pair of the depending legs 20*a*, 20*b* on opposite sides of the slider 10**.

When the wings 21 and 22 are folded down to their final side wall position from the wing position in FIG. 7 to the side wall position shown in FIG. 8 the side walls 21 and 22 are snapped into position and held by molded latches to the legs at one or both ends of the slider. The molded latches have been illustrated as shown in FIG. 7 by the ribs 21b and 22b which mate respectively with the interlocking grooves 20c, 20c on the depending legs 20a.

As may be seen in FIGS. 2-6 the foldable depending side walls 21 and 22 extend from an opening end 10a of the slider 10 to a closing end 10b. The side walls 21 and 22 are spaced wider apart at the opening end 10a of the slider 10, FIGS. 2 and 3, to permit separation of the rib and groove elements 14 and 15 and are spaced sufficiently close together at the closing end 10b of the slider, FIG. 6, to press the rib and groove elements 14 and 15 into interlocking relationship as the slider 10 is moved in a fastener closing direction. The side walls 21 and 22 at their lower ends are provided with inwardly extending shoulder structure 21c and 22c, FIGS. 3 and 4 for engaging the bottom of the fastener comprising the rib and groove elements 14 and 15 to prevent the slider 10 from being lifted off the top edge of the fastener while the slider straddles the fastener as shown in FIGS. 2 and 8.

Figure 3:
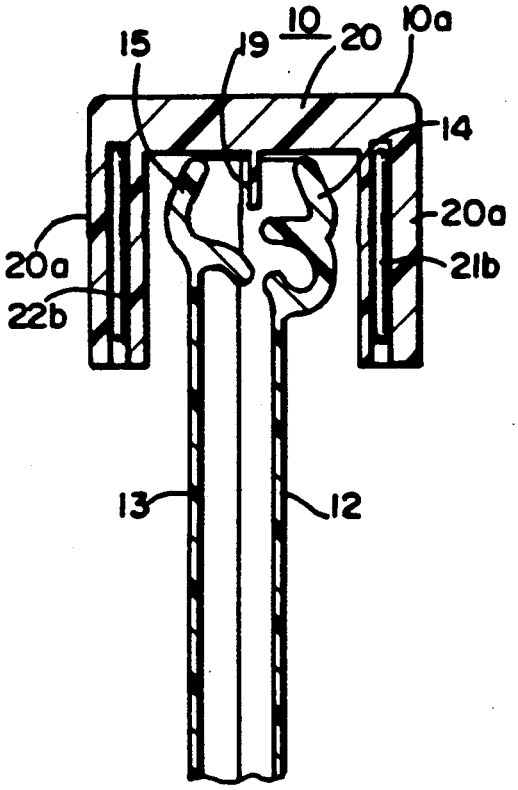
FIG. 3 is a sectional view taken along the lines 3—3 in FIG. 2.
Figure 4:
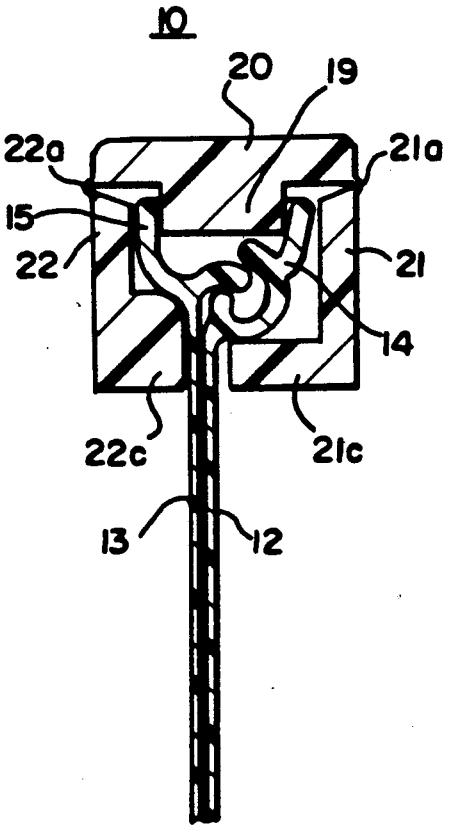
FIG. 4 is a sectional view taken along the lines 4—4 in FIG. 2.
Figure 5:
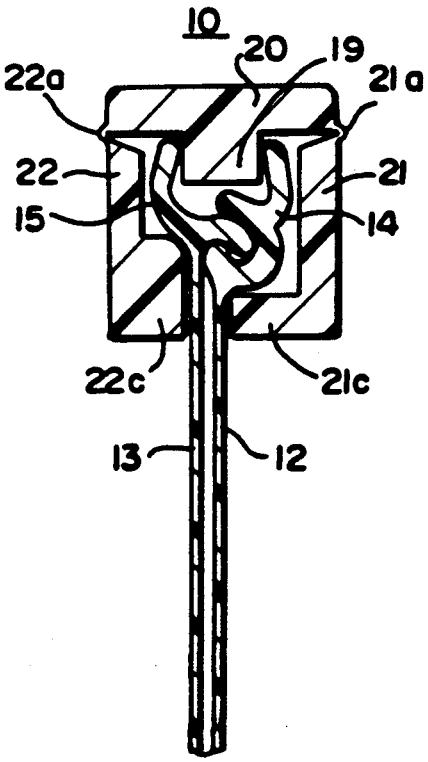
FIG. 5 is a sectional view taken along the lines 5—5 in FIG. 2.
Figure 6:
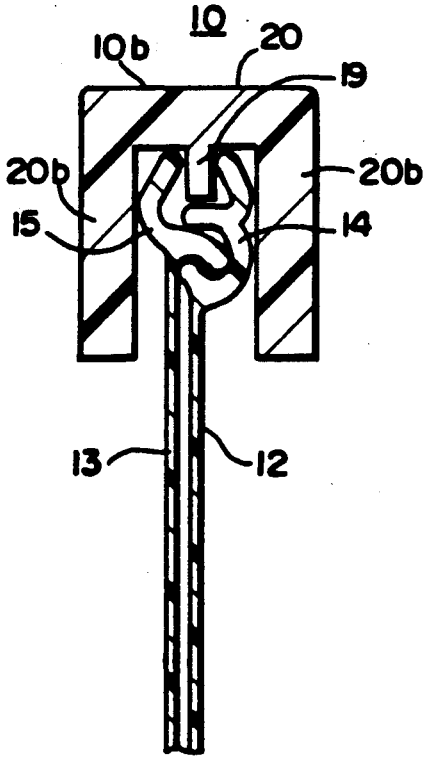
FIG. 6 is a sectional view taken along the lines 6—6 in FIG. 2.

The depending plastic separator finger 19 which extends between the side walls 21 and 22 is wider adjacent the opening end 10a of the slider 10 for separating the rib and groove elements 14 and 15 as the slider 10 is moved in the fastener opening direction, FIGS. 2-4. The tip of the separator finger 19 is tapered at the opening end 10a so that the slider 10 may be moved easily in the fastener closing direction.

Referring to FIGS. 7 and 8 there is illustrated the method of assembling the foldable plastic slider 10 with the profile plastic reclosable fastener of a thermoplastic bag formed by the pair of flexible plastic sheets 12 and 13 having a top edge with separable fastener means at the top edge extending along the length thereof having reclosable interlocking rib and groove profile elements 14 and 15 on the facing surfaces thereof. The interlocking rib and groove profile elements 14 and 15 on the facing surfaces are placed in alignment so that they can be joined as indicated at the right hand end of FIGS. 2 and 7. The foldable slider 10 is positioned above the profile elements 14 and 15 as shown in FIG. 7. When the elements 14 and 15 are joined as indicated at the right hand end of FIG. 8, the legs 20b at the closing end 10b of the slider 10 straddle these elements and the depending finger 19 is inserted between the elements 14 and 15 as shown in FIG. 8. The body 20 of the slider 10 then rests on the top of the elements 14 and 15. The wings 21 and 22 are then folded down to their side wall position shown in FIG. 8 and snapped into position with the ribs 21b and 22b mating respectively with the interlocking grooves 20c, 20c on the depending legs 20a, FIGS. 7 and 8. In this assembled position the shoulders 21c and 22c on the side walls 21 and 22 are positioned beneath the bottom of the fastener elements 14 and 15, FIGS. 4, 5 and 8, to prevent the slider 10 from being lifted off the top edge of the fastener.

Since the side walls 21 and 22 of the foldable slider 10 are integral with the body portion 20 this provides for ease in assembly as distinguished from multiple part sliders. Also since the slider is made from plastic material it can be used on a food bag in a microwave whereas a metal slider cannot. While the preferred form of the invention has been described in connection with a living hinge other plastics which are not suitable for making a living hinge can be used. Thus more brittle plastics can be used as it is only necessary that the side walls be snapped into place once since the slider is not removed from the reclosable fastener elements once it is assembled.

While the preferred embodiment of the invention has been described and illustrated in connection with interlocking rib and groove profiles of the shapes disclosed and claimed in the aforesaid related application Ser. No. 490,110, it is to be understood that the novel foldable plastic slider of the present invention is also applicable to profiled plastic reclosable fasteners or zippers of the conventional configuration such as shown in U.S. Pat. No. 3,660,875. An example of such plastic zipper is disclosed in connection with the embodiments illustrated in FIGS. 9 and 10. The reclosable interlocking rib and groove profile elements have been identified by the reference characters 14' and 15' respectively. The slider 10' is similar to the slider 10 and straddles the reclosable fastener elements 14' and 15' at the top of the bag 11' and is adapted for opening or closing the reclosable fastener elements. The novel slider 10' is formed from a single piece of molded plastic comprising a wedge-shaped separator finger 19' and interlocking complimentary structure for moving along the fastener. The separator finger 19' is longer than the separator finger 19 of FIGS. 1-8 as it extends between and engages the interlocking rib and groove elements. The complimentary structure comprises an inverted U-shaped member including a transfer support member or body 20' from which the wedge-shaped separator finger 19' depends. The body 20' is adapted to move along the top edges of the fastener elements 14' and 15' and includes a pair of hinged "wings" or sidewalls 21' and 22' that can be folded down into their final position holding the slider 10' onto the fastener elements. The wings 21' and 22' are hinged to the main slider body 20' by means of hinge structure 21a' and 22a'. The hinge structure 21a' and 22a' is a relatively thin section of the plastic material as compared to the wall thicknesses of the wings 21' and 22' and the flexibility of the plastic material makes possible the use of the integral hinge structure 21a' and 22a' which as referred to earlier is sometimes called a "living" hinge. At the opposite ends of the slider 10' the main body 20' is provided with depending structure in the form of two pairs of legs 20a', 20b' and the wings or foldable side walls 21' and 22' are positioned between the pair of depending legs 20a', 20b' on the opposite slides of the slider 10'. When the wings 21' and 22' are folded down to their final sidewall position from the wing position to the sidewall position shown in FIG. 9, the sidewalls 21' and 22' are snapped into position and held by molded latches to the legs at one or both ends of the slider. The molded latches may be similar to those illustrated and described in connection with FIG. 7.

Figure 9:
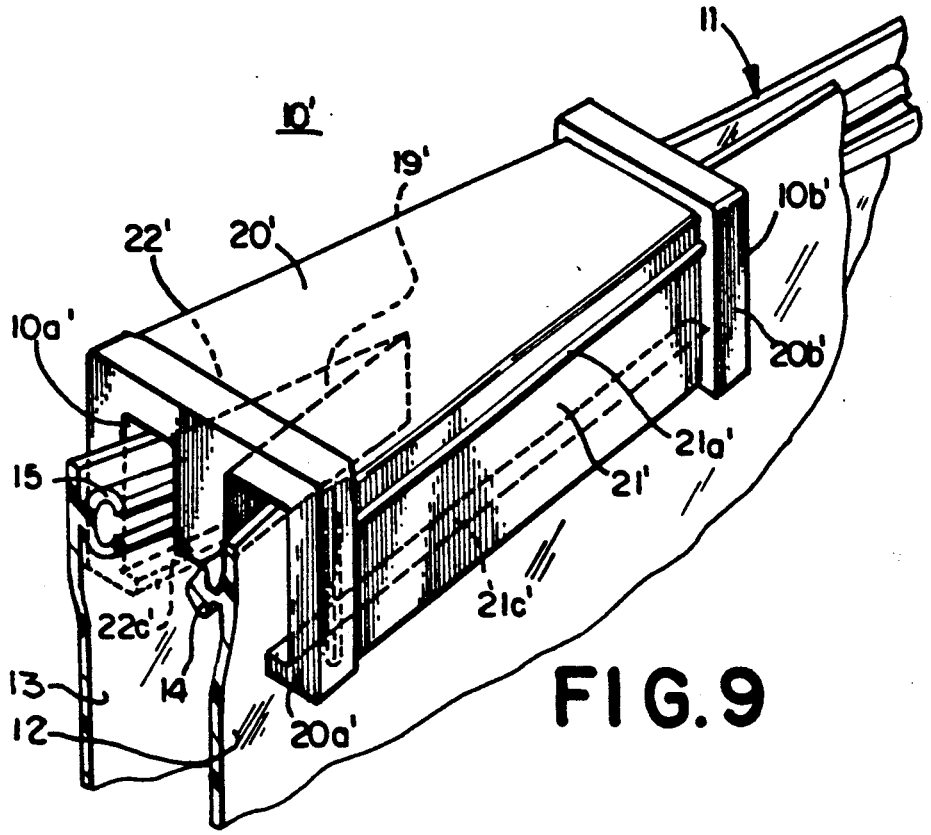
FIG. 9 is perspective view of a modification of a foldable plastic slider in accordance with the present invention.

The foldable depending sidewalls 21' and 22' extend from an opening end 10a' of the slider 10' to a closing end 10b'. The sidewalls 21' and 22' are spaced wider apart at the opening end 10a' of the slider 10' to permit separation of the rib and groove elements 14' and 15' and are spaced sufficiently close together at the closing end 10b' of the slider to press the rib and groove elements 14' and 15' into interlocking relationship as the slider 10' is moved in a fastener closing direction. The sidewalls 21' and 22' at their lower ends are provided with inwardly extending shoulder structure 21c' and 22c' for engaging the bottom of the fastener comprising the rib and groove elements 14' and 15' to prevent the slider 10' from being lifted off the top edge of the fastener while the slider straddles the fastener as shown in FIG. 9. The depending plastic separator finger 19' which extends between the sidewalls 21' and 22' is wider adjacent the opening end 10a' of the slider 10' for separating the rib and groove elements 14' and 15' as the slider 10' is moved in the fastener opening direction.

Figure 10:
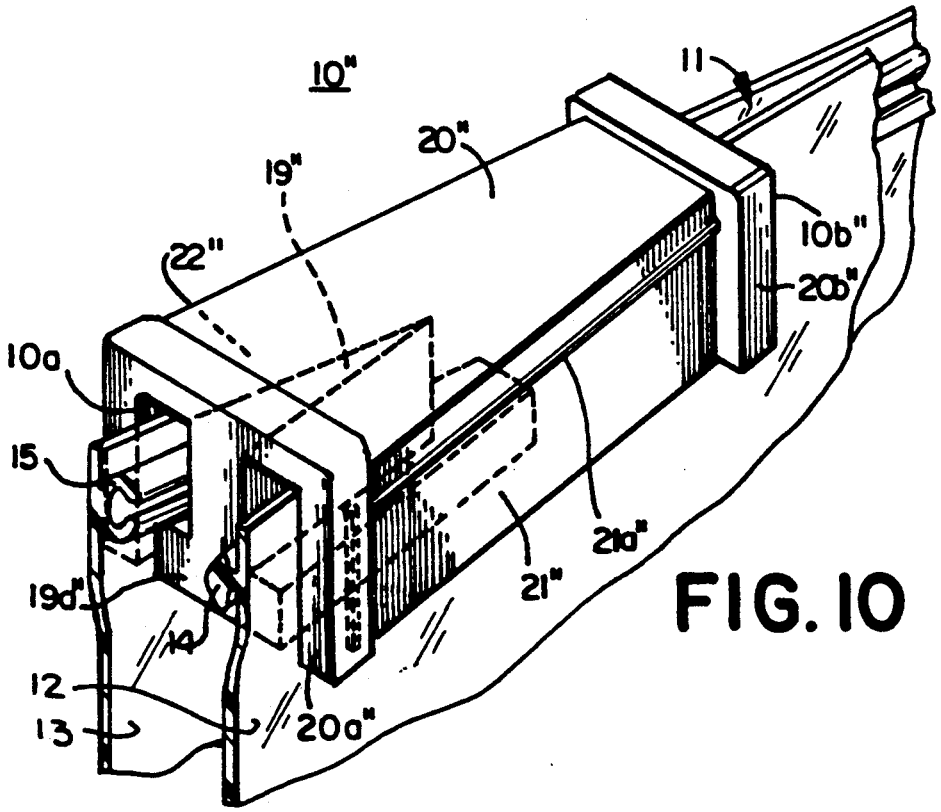
FIG. 10 is a perspective view of another modification of a foldable plastic slider in accordance with the present invention.

The modification of the slider 10'' illustrated in FIG. 10 is similar to the modification of the slider 10' illustrated and described in connection with FIG. 9 with the exception that the depending plastic separator finger 19'' is provided with shoulder structure 19a'' extending horizontally from the opposite sides thereof for cooperation with the underside of the interlocking rib and groove profile elements 14' and 15' to prevent the slider 10'' from being lifted off of the plastic zipper. By providing the shoulder structure 19a'' on the depending finger 19'', it is not necessary to provide the shoulder structure on the bottom of the wings or sidewalls 21'' and 22''. The corresponding parts of the slider 10'' in FIG. 10 have been identified in the drawing with corresponding reference characters but with the addition of the double prime symbol.

The method of assembly disclosed herein is particularly suited for the manufacture of thermoplastic bags on a production line where the bags move sequentially along the production line. The foldable plastic slider 10, 10' or 10'' may be assembled with the bags prior to the formation of the side seals or after the formation of the side seals and severing of the individual bags as desired. In any event the foldable plastic slider is assembled with the reclosable fastener structure at periodic intervals along the plastic profiles with one fastener for each bag to be manufactured.

While preferred embodiments of the invention have been described and illustrated, it is to be understood that further modifications thereof may be made within the scope of the appended claims without departing from the spirit of the invention.

What is claimed is:

1. A foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking rib and groove profile elements on the respective sheets, the straddling slider for closing or opening the reclosable fastener elements comprising a separator finger and interlocking complementary structure formed from plastic for moving along the fastener, the complementary structure comprising a transverse support member having the wedged-shaped separator finger depending therefrom, said support member having depending structure located on opposite sides of said separator finger, a pair of side walls connected to said support member at locations adjacent said depending structure and at least one of said side walls being foldable relative to said depending structure, and means for interlocking said depending structure with said side walls to interlock said side walls with said support member, said side walls extending from an opening end of the slider to the closing end, the side walls being spaced wider apart at the opening end to permit separation of the rib and groove elements by the separator finger extending between the side walls at the opening end, the side walls being spaced sufficiently close together at the closing end to press the rib and groove elements into interlocking relationship as the slider is moved in a fastener closing direction, at least one of said separator finger and said side walls having shoulder structure on the bottom thereof for cooperating with the bottom of the fastener to prevent the slider from being lifted off the top edge of the fastener while the slider straddles the fastener.

2. A plastic slider according to claim 1 wherein said side walls and said depending structure include interlocking structure to interlock said side walls with said support member.

3. A plastic slider according to claim 1 wherein both of said side walls are hinged to said support member and foldable relative to said depending structure.

4. A plastic slider according to claim 3 wherein said depending structure comprises depending legs on the opposite sides of said support member and said pair of side walls are hinged to said support member adjacent said depending legs.

5. The method of assembly of a plastic slider in straddling relation with a profiled plastic reclosable fastener particularly suited for thermoplastic bags and the like formed by a pair of flexible sheets each having a top edge with separable fastener means extending along the length thereof comprising reclosable interlocking rib and groove profile elements on the respective sheets, the straddling slider for closing or opening the reclosable fastener elements comprising a separator finger and complementary structure formed from plastic for moving along the fastener, the complementary structure including hinged side walls extending from an opening end of the slider to a closing end, the side walls being spaced wider apart at the opening end to permit separation of the rib and groove elements by the separator finger extending between the side walls at the opening end, the side walls being spaced sufficiently close together at the closing end to press the rib and groove elements to interlocking relationship as the slider is moved in a fastener closing direction, the method comprising the steps of placing the interlocking rib and groove profile elements in alignment so that they can be joined, supporting the separator finger between the rib and groove profile elements with the pair of side walls extending outwardly from the sides of the separator finger, pressing the rib and groove profile elements together so that the profiles are interlocked at the location adjacent the closing end of the slider and against the sides of the separator finger, folding the pair of side walls in a direction toward the separator finger so that the side walls straddle the rib and groove profile elements of the fastener, and securing the pair of side walls in folded position relative to the separator finger to prevent the slider from being lifted off the top edge of the fastener while the slider straddles the fastener.

6. The method according to claim 5 wherein at least one of said finger and said side walls includes shoulder structure for cooperating with the bottom of the male and female fastener profile to maintain the slider on the fastener.

7. The method of assembly of a plastic slider in straddling relation with a profiled plastic reclosable fastener particularly suited for thermoplastic bags and the like formed by a pair of flexible sheets each having a top edge with separable fastener means extending along the length thereof comprising reclosable interlocking rib and groove profile elements on the respective sheets, the straddling slider for closing or opening the reclosable fastener elements comprising a separator finger and complementary structure formed from plastic for moving along the fastener, the complementary structure including hinged side walls extending from an opening end of the slider to a closing end, the side walls being spaced wider apart at the opening end to permit separation of the rib and groove elements by the separator finger extending between the side walls at the opening end, the side walls being spaced sufficiently close together at the closing end to press the rib and groove elements to interlocking relationship as the slider is moved in a fastener closing direction, the method comprising the steps of placing the interlocking rib and groove profile elements in alignment so that they can be joined, supporting the separator finger between the rib and groove profile elements, pressing the rib and groove profile elements together so that the profiles are interlocked at the location adjacent the closing end of the slider and against the sides of the separator finger, folding the pair of side walls in a direction toward the separator finger so that the side walls straddle the rib and groove profile elements of the fastener, and securing the pair of side walls in folded position relative to the separator finger to prevent the slider from being lifted off the top edge of the fastener while the slider straddles the fastener, wherein at least one of said finger and said side walls includes shoulder structure for cooperating with the bottom of the male and female fastener profile to maintain the slide on the fastener, and wherein said pair of side walls include structure for locking said pair of said side walls in folded position with respect to said separator finger.

8. The method of assembly of a foldable plastic slider comprising a separator finger and complementary structure including a pair of foldable winds, with a profiled plastic reclosable fastener particularly suited for thermoplastic bags for opening and closing the fastener comprising:

positioning a plastic bag having a plastic reclosable fastener along the top edges of the front and back faces of the bag to receive the foldable plastic slider in straddling relation, the fastener having a female fastener profile attached to one of the faces of the bag and a male profile attached to the other face of the bag, inserting the plastic separator finger between the male and female profiles with the pair of foldable wings extending outwardly from the sides of the plastic separator finger, and forming the slider in straddling relation around the male and female fastener profiles at the top edges of the bag by folding the pair of wings downwardly and toward the plastic separator finger and into locking relation therewith to form a pair of side walls for the slider whereby movement of the slider in one direction opens the fastener and movement in the opposite direction recloses the fastener.

9. The method according to claim 8 wherein the pair of side walls have shoulder portions at the bottom end thereof for cooperating with the bottom of the male and female fastener profile to maintain the slider on the fastener.

10. A foldable plastic slider for straddling a profiled plastic reclosable fastener particularly suited for thermoplastic bags for opening and closing the fastener comprising plastic body structure having a separator finger depending therefrom for insertion between the elements of the reclosable fastener, said body structure having a pair of foldable wings attached thereto and said body structure having depending structure located on opposite sides of said separator finger, said foldable wings being foldable downwardly into a lowered straddling relation with the profiled plastic reclosable fastener therebetween, said foldable wings having at the outer ends thereof inwardly extending shoulder structure, said foldable wings and said depending structure including interlocking structure to interlock said foldable wings in their lowered position to provide side walls for said slider whereby said shoulders cooperate with the bottom of the reclosable fastener to prevent the slider from being lifted off the top of the fastener while the slider straddles the fastener.

11. A foldable plastic slider according to claim 10 wherein said depending structure comprises depending legs with at least one leg on the opposite sides of said body and said foldable wings are hinged to said body at locations adjacent said depending legs.

* * * * *